US007117766B1

(12) United States Patent
Boehringer

(10) Patent No.: US 7,117,766 B1
(45) Date of Patent: Oct. 10, 2006

(54) WRENCH ASSEMBLY

(76) Inventor: Martin L. Boehringer, 1348 Columbus Dr., Spanish Lake, MO (US) 63138

( * ) Notice: Subject to any disclaimer, the term of this patent is extended or adjusted under 35 U.S.C. 154(b) by 0 days.

(21) Appl. No.: 11/287,348

(22) Filed: Nov. 28, 2005

(51) Int. Cl.
*B25B 13/06* (2006.01)
*B25B 13/02* (2006.01)

(52) U.S. Cl. ..... 81/121.1; 81/121; 81/125

(58) Field of Classification Search ..... 81/121, 81/125, 125.1, 176.1, 121.1; D8/16–29
See application file for complete search history.

(56) References Cited

U.S. PATENT DOCUMENTS

| | | | | | |
|---|---|---|---|---|---|
| 1,129,049 | A | | 2/1915 | Smith | |
| 1,529,075 | A | * | 3/1925 | McIntyre | 81/124.3 |
| D130,756 | S | * | 12/1941 | Howard | D8/17 |
| 3,590,895 | A | * | 7/1971 | Wirtanen | 81/438 |
| 3,733,938 | A | | 5/1973 | Smith | |
| 3,772,943 | A | | 11/1973 | Itano | |
| D268,473 | S | * | 4/1983 | Rust | D8/17 |
| D287,927 | S | * | 1/1987 | Zankich | D8/17 |
| D288,893 | S | * | 3/1987 | Epstein | D8/17 |
| 5,699,701 | A | | 12/1997 | Cotten, Jr. | |
| D416,178 | S | * | 11/1999 | Moore et al. | D8/16 |
| D420,263 | S | | 2/2000 | Wei | |
| 6,131,492 | A | | 10/2000 | Mai | |
| D442,836 | S | * | 5/2001 | Hunter | D8/26 |
| 6,912,936 | B1 | * | 7/2005 | Hume | 81/119 |
| 2005/0166714 | A1 | * | 8/2005 | Fowler | 81/57.3 |

* cited by examiner

*Primary Examiner*—Lee D. Wilson
*Assistant Examiner*—Alvin J. Grant

(57) ABSTRACT

A wrench assembly includes a plate that has a first side, a second side, a first end edge, a second end edge, a first side edge and a second side edge. The plate has an end opening therein extending into the first side and outwardly of the second side. The end opening is elongated and has a shape configured for engaging the wing head. The end opening is positioned nearer to the first end edge than the second end edge. A wing head, attached to a drain plug, may be engaged with and rotated by the plate.

4 Claims, 2 Drawing Sheets

WRENCH ASSEMBLY

BACKGROUND OF THE INVENTION

1. Field of the Invention

The present invention relates to wrench devices and more particularly pertains to a new wrench device for engaging a wing head drain plug positioned in a compressor.

2. Description of the Prior Art

The use of wrench devices is known in the prior art. While these devices fulfill their respective, particular objectives and requirements, the need remains for a device that is configured for engaging wing-nut type heads and in particular wing heads drain plugs used for compressors. The tool would allow a person to more easily rotate the drain plug.

SUMMARY OF THE INVENTION

The present invention meets the needs presented above by generally comprising a plate that has a first side, a second side, a first end edge, a second end edge, a first side edge and a second side edge. The plate has an end opening therein extending into the first side and outwardly of the second side. The end opening is elongated and has a shape configured for engaging the wing head. The end opening is positioned nearer to the first end edge than the second end edge. A wing head, attached to a drain plug, may be engaged with and rotated by the plate.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
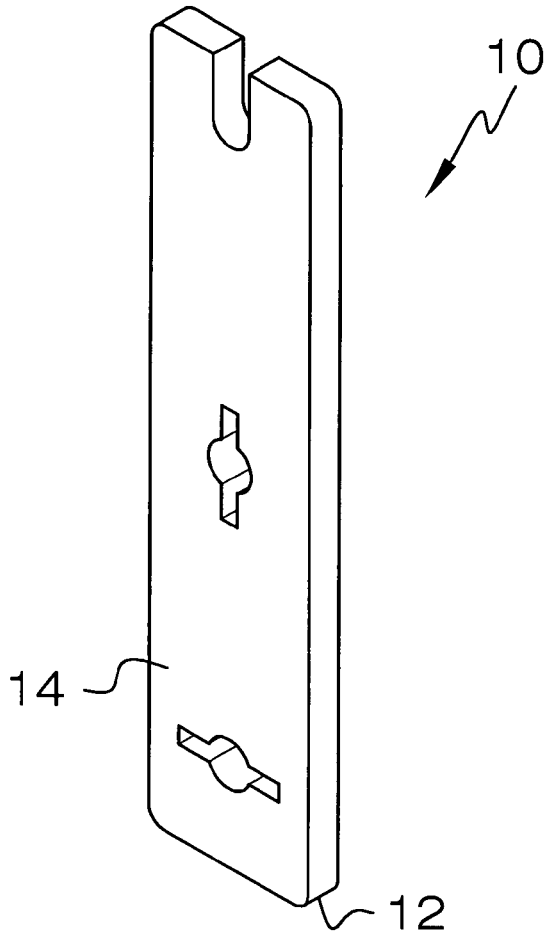
FIG. 1 is a perspective view of a wrench assembly according to the present invention.
Figure 2:
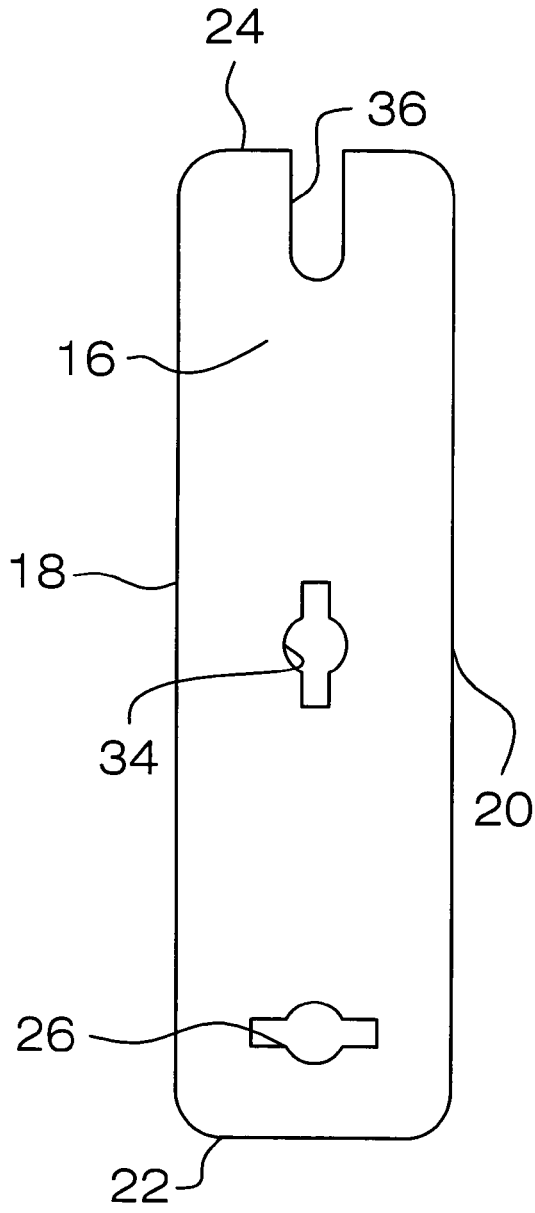
FIG. 2 is a rear view of the present invention.

With reference now to the drawings, and in particular to FIGS. 1 through 5 thereof, a new wrench device embodying the principles and concepts of the present invention and generally designated by the reference numeral 10 will be described.

As best illustrated in FIGS. 1 through 5, the wrench assembly 10 generally comprises a plate 12 that has a first side 14, a second side 16, a first end edge 22, a second end edge 24, a first side edge 18 and a second side edge 20. The plate 12 has an end opening 26 therein extending into the first side 14 and outwardly of the second side 16. The end opening 26 is elongated and has a shape configured for engaging a wing head 28 attached to a conventional drain plug 30 used on a compressor 32. The end opening 26 is positioned nearer to the first end edge 22 than the second end edge 24. The end opening 26 is elongated along a line orientated perpendicular to the first side edge 18.

The plate 12 has a central opening 34 therein extending into the first side 14 and outwardly of the second side 16. The central opening 34 is elongated and has a shape configured for engaging the wing head 28. The central opening 34 is positioned between the first 22 and second 24 end edges. The central opening 34 is elongated along a line orientated parallel to the first side edge 18.

The second end edge 24 has a slot 36 extending therein and that is configured for engaging a portion of the wing head 28. The plate 12 has a length from the first end edge 22 to the second end edge 24 between 4 inches and 6 inches, a width from the first lateral edge 18 to the second lateral edge 20 between 1½ inches and 3 inches, and a height between ⅛ inch and ½ inch.

Figure 3:
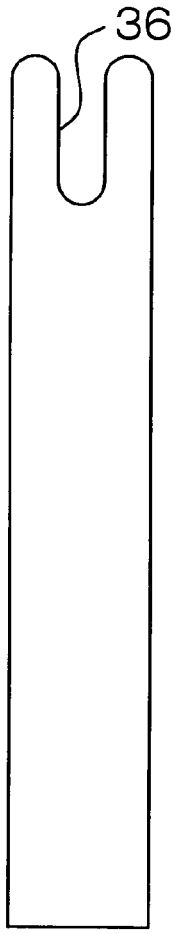
FIG. 3 is a front view of a second embodiment of the present invention.
Figure 4:
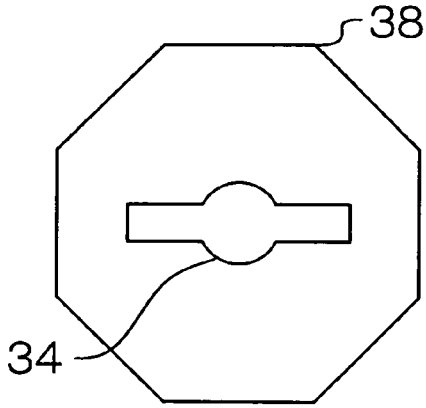
FIG. 4 is a front view of a third embodiment of the present invention.
Figure 5:
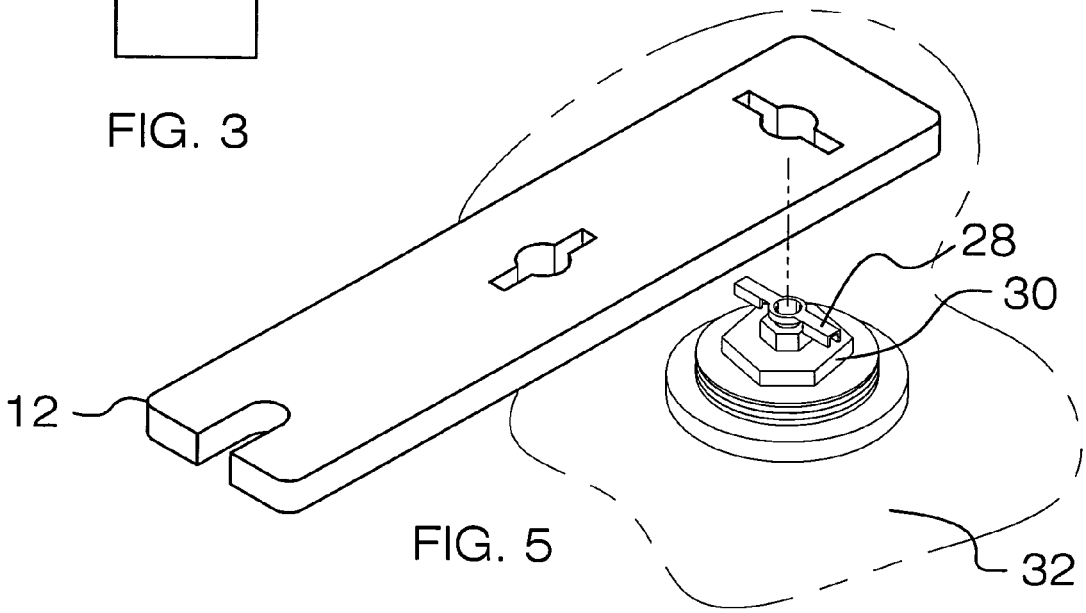
FIG. 5 is a perspective in-use view of the present invention.

FIG. 3 shows a second embodiment of the wrench tool 10 having no openings therein but only a slot 36 extending into the second end edge 24. FIG. 4 shows a plate 38 having a octagonal shape and only including the central opening 34.

In use, the plate 12 may be engaged with the wing head 28 so that the drain plug can be rotated with the plate 12. The multiple openings 26, 34 and slot 36 allow for varying positioning of the plate 12 with respect to the wing head 28 to ensure that the wing head 28 may be engaged with the plate 12. The plate 12 provides its user with additional torque when rotating the wing head 28.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A wrench tool for rotating a drain plug having a wing head, said wrench tool comprising:

a plate having a first side, a second side, a first end edge, a second end edge, a first side edge and a second side edge, said plate having an end opening therein extending into said first side and outwardly of said second side, said end opening being elongated and having a shape configured for engaging the wing head, said end opening being positioned nearer to said first end edge than said second end edge, said end opening being elongated along a line orientated perpendicular to said first side edge, said plate having a central opening therein extending into said first side and outwardly of said second side, said central opening being approximately equally spaced from said first and second end edges, said central opening being elongated and having a shape configured for engaging the wing head, said central opening being positioned between said first and second end edges, said central opening being elongated along a line orientated parallel to said first side edge; and wherein the wing head may be engaged with the plate and the drain plug rotated with the plate.

2. The wrench tool according to claim 1, wherein said second end edge having a slot extending therein and being configured for engaging a portion of the wing head.

3. A wrench tool for rotating a drain plug having a wing head, said wrench tool comprising:

a plate having a first side, a second side, a first end edge, a second end edge, a first side edge and a second side edge, said plate having an end opening therein extending into said first side and outwardly of said second side, said end opening being elongated and having a shape configured for engaging the wing head, said end opening being positioned nearer to said first end edge than said second end edge, said end opening being elongated along a line orientated perpendicular to said first side edge, said plate having a central opening therein extending into said first side and outwardly of said second side, said central opening being elongated and having a shape configured for engaging the wing head, said central opening being positioned between said first and second end edges, said central opening being elongated along a line orientated parallel to said first side edge, said second end edge having a slot extending therein and being configured for engaging a portion of the wing head, said plate having a length from said first end edge to said second end edge between 4 inches and 6 inches, a width from said first lateral edge to said second lateral edge between 1½ inches and 3 inches, and a height between ⅛ inch and ½ inch; and wherein the wing head may be engaged with the plate and the drain plug rotated with the plate.

4. A wrench tool for rotating a drain plug having a wing head, said wrench tool comprising:

a plate having a first side, a second side, plate having a octagonal shape, said plate having a central opening therein extending into said first side and outwardly of said second side, said central opening being elongated and having a shape configured for engaging the wing head, said central opening being centrally positioned in said first side of said plate and being aligned with a central point of said plate; and wherein the wing head may be engaged with the plate and the drain plug rotated with the plate.

* * * * *